US005164632A

United States Patent [19]

Yoshida et al.

[11] Patent Number: 5,164,632

[45] Date of Patent: Nov. 17, 1992

[54] ELECTRON EMISSION ELEMENT FOR USE IN A DISPLAY DEVICE

[75] Inventors: Yoshihiro Yoshida, Atsugi; Yukihiro Ageishi, Kawasaki; Masaru Shinkai, Yokohama, all of Japan

[73] Assignee: Ricoh Company, Ltd., Tokyo, Japan

[21] Appl. No.: 696,913

[22] Filed: May 8, 1991

[30] Foreign Application Priority Data

May 31, 1990 [JP] Japan ..... 2-142491

[51] Int. Cl.[5] ..... H01J 1/30

[52] U.S. Cl. ..... 313/309; 313/336; 313/351

[58] Field of Search ..... 313/309, 310, 311, 536, 313/351, 355

[56] References Cited

U.S. PATENT DOCUMENTS 3,753,022 8/1973 Fraser, Jr. ..... 313/355 X
4,345,181 8/1982 Shelton ..... 313/309
4,683,399 7/1987 Soclof ..... 313/309 X

FOREIGN PATENT DOCUMENTS 0086427 3/1989 Japan .

*Primary Examiner*—Donald J. Yusko
*Assistant Examiner*—Ashok Patel
*Attorney, Agent, or Firm*—Oblon, Spivak, McClelland, Maier & Neustadt

[57] ABSTRACT

An electron emission element includes an electrically insulation member made from an anodic oxidation film and having an upper surface, a lower surface and a plurality of pores. Each pore has an opening in the upper surface of the insulation member. An electron emission member is disposed in each of the pores of the insulation member. The emission member is made from conductive material and has a pointed end directed toward the opening of the pore. An electrode is disposed around an upper portion of each of the pores. The electrode is separated from the electron emission member disposed in the pore.

3 Claims, 5 Drawing Sheets

ELECTRON EMISSION ELEMENT FOR USE IN A DISPLAY DEVICE

BACKGROUND OF THE INVENTION

1. Field of the Invention

The present invention relates to an electron emission element and a process for producing the same. More particularly, it relates to the electron emission element which is used in a display device or a micro-fabrication device such as CRT and the process for producing such a device.

2. Description of the Related Art

Japanese Patent Application Laying Open (KOKAI) No. 64-86427 discloses an electron emission element and a process for producing the element which is applicable to a flat CRT or the like. The electron emission element disclosed in the patent document is constituted in such a way that a recess is formed in an oxide film of $SiO_2$ so as to form a cathode chip having a tip in the recess and that a gate is formed on the oxide film surface.

The flat CRT has not been commercialized yet. In order for the flat CRT to be accepted in the market, it is necessary to not only upgrade the display quality of the CRT but also lower its cost as well.

The display quality of the CRT depends on the evenness of luminance. Therefore, to upgrade the display quality, it is efficacious to even the electron emission flow from each chip to minimize the luminance distribution on the display by constituting one pixel (picture element) from a plurality of cathode arrays. The density of the cathode array, i.e., the density of electron emission area in the array is about $10^5/cm^2$ to $10^7/cm^2$.

Also, to lower the cost, it is necessary to simplify the electron emission structure of the element to raise the throughput of production of the elements.

However, in accordance with the electron emission element of the related art so far, the density of the electron emission area or member is low and the throughput is insufficient to commercialize the flat CRT since the chip and the gate of the element are formed with the use of a photomask.

SUMMARY OF THE INVENTION

It is therefore an object of the present invention to provide an electron emission element and a process for producing the element which enables one to form electron emission areas (or members) of high density and raise the production throughput of elements.

The above-mentioned object of the present invention can be achieved by an electron emission element comprising:

an electrically insulation member made from an anodic oxidation film and having an upper surface, a lower surface and a plurality of pores each of which has an opening in the upper surface;

an electron emission member disposed in each of the pores of the insulation member, the emission member being made from conductive material and having a pointed end directing toward the opening of the pore; and an electrode disposed around an upper portion of each of the pores, the electrode being separated from the electron emission member disposed in the pore.

More precisely, in order to achieve the object, the electron emission element of the present invention comprises: an electrically insulation member having an upper surface and a lower surface as well as minute apertures opening in the upper surface; a conductive chip having a pointed end and formed in the aperture; and a conductive gate electrode formed in the aperture and/or on the upper surface of the insulation member and separated from the chip, wherein the insulation member is constituted from an anodic oxidation film made from Al (aluminium).

Also, to achieve the object of the present invention, the process for producing the electron emission element in accordance with the present invention includes: a step for forming a chip having a pointed end by such a way that an electrically insulation member having minute apertures formed therein and a conductive member housed in each aperture is arranged in such a manner that an axial direction of the aperture is inclined with respect to an ion beam irradiation direction so that the ion beam is irradiated to the conductive member and the insulation member while the insulation member is rotated about the axis of the aperture; and a step for forming a gate electrode by arranging the insulation member in such that the axial direction of the aperture is inclined with respect to the evaporation direction of the conductive member so that the conductive member is evaporated to the insulation member while the insulation member is rotated about the axis of the aperture.

An advantage of the present invention is that since the insulation member is made from the anodic oxidation film, it becomes possible to utilize the minute pores of the anodic oxidation film as the apertures of the insulation member, whereby the density of the electron emission area or member is increased.

Another advantage of the present invention is that it becomes possible to easily fabricate the electron emitting portion or member of the element and reduce the cost of the element since it becomes unnecessary to use a photomask at the time of forming the chips (electron emission members) or the gate electrodes.

Therefore, it becomes possible to raise the production throughput of the electron emission element having a high density emission area or member.

Further objects and advantages of the present invention will be apparent from the following description of the preferred embodiments of the invention as illustrated in the accompanying drawings.

DESCRIPTION OF THE PREFERRED EMBODIMENTS

Embodiments of the present invention are described hereinafter with reference to the drawings.

FIGS. 1 to 12 represent an embodiment of the electron emission element in accordance with the present invention.

The construction of the electron emission element is described first.

Figure 1:
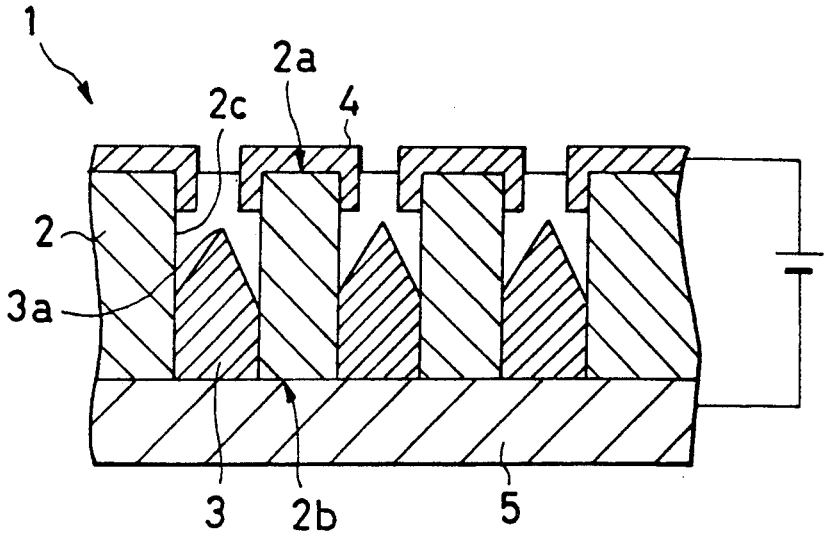
FIG. 1 is a sectional view of an embodiment of the electron emission element in accordance with the present invention.

In FIG. 1, numeral 1 designates an electron emission element as a whole. "Electron emission" here means that the electrons are emitted at the normal temperature when the electric field intensity is raised to about $10^9$ V/m.

The element 1 comprises an electric insulation member 2, chips 3, gates 4 and an address line 5. The member 2 has an upper surface 2*a* and a lower surface 2*b* as well as pores 2*c* which are open in the upper surface 2*a*. The member 2 is constituted from an anodic oxidation film formed from $Al_2O_3$ made by anodic oxidation of Al.

The chip 3 has a pointed tip end 3*a* and is made from conductive material such as Au. Each chip 3 is arranged in each of the pores 2*c* of the member 2. The gate 4 is also made from conductive material such as Au and disposed at least on one of the portions on the upper surface 2*a* of the member 2 and inside the pore. In this particular embodiment, the gate 4 is deposited on the upper surface 2*a* of the member 2 and on the inner wall of the upper portion inside the pore 2*c*. The gate 4 is separated from the chip 3. The address line 5 is made from conductive material such as Au and arranged in contact with the lower surface 2*b* of the member 2 and the chip 3 so that the address line 5 is electrically connected with the chip 3. Accordingly, by applying an electric field to the address line 5 and the gate 4, it becomes possible to emit electrons from the end 3*a* of the chip 3. Note that the gate 4 is called a grid in a triode.

Next, a process for producing the above-mentioned element 1 is described hereinafter with reference to FIGS. 2 to 12.

Figure 2:
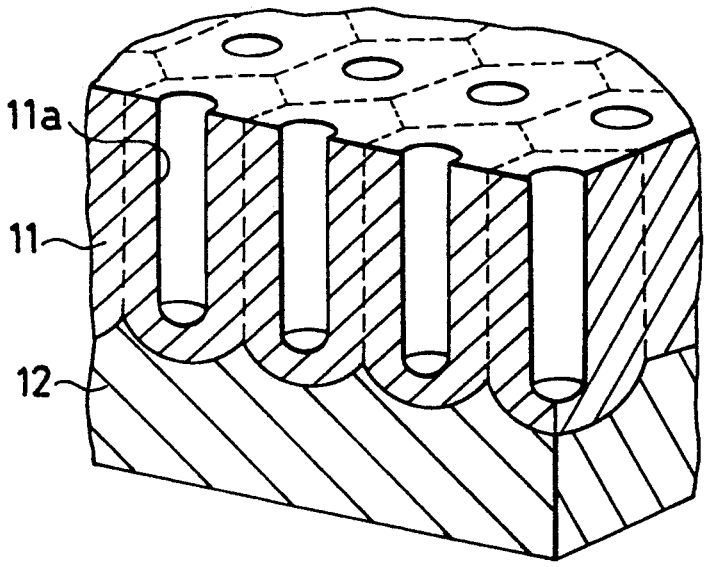
FIG. 2 is an explanatory perspective view of the anodic oxidation film of the electron emission element of FIG. 1.
Figure 3:
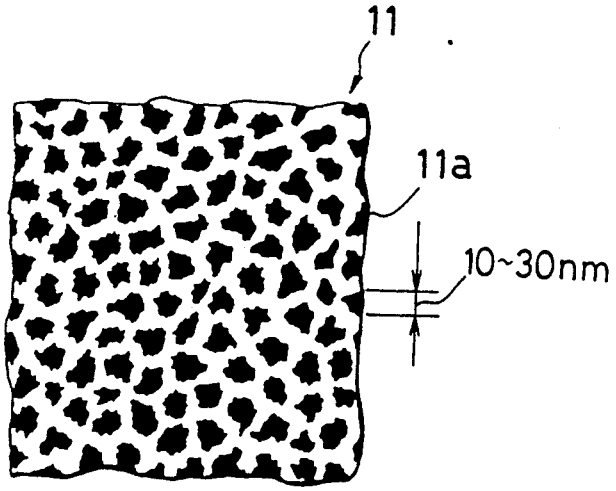
FIG. 3 is an explanatory view of the anodic oxidation film of the electron emission element of FIG. 1.

First, an upper surface of an Al substrate (not shown) is treated by anodic oxidation in such a way that the Al substrate is oxidized in sulfuric acid of 5 to 20% at a temperature within a range from 0 to 20° C., the temperature being kept constant within a fluctuation range of ±2° C., and the current density being arranges 0.6 to 3 A/dm$^2$, for 5 to 60 minutes. By this anodic oxidation process of the Al substrate, an anodic oxidation film 11 of $Al_2O_3$ having a number of pores 11*a* is formed in the upper surface of the substrate to the thickness of 1 to 100 μm, as illustrated in FIGS. 2 and 3. The diameter of each pore 11*a* is 10 to 30 nm. The pitch of the pores 11*a* is 30 to 100 nm or less. The density of the pores is $10^9$ to $10^{11}$ per cm$^2$. Numeral 12 designates the Al portion of the substrate which is unoxidized.

Figure 4:
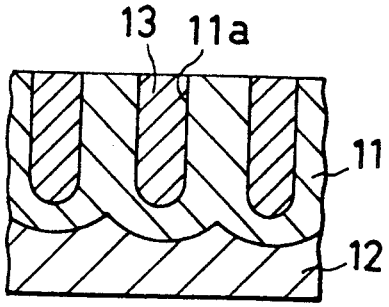
FIGS. 4 to 12 are explanatory sectional views for explaining an example of the process for producing the electron emission element of the present invention.

After that, as illustrated in FIG. 4, Au, for instance, is deposited in the pores 11*a* of the film 11 by an electrolytic process so that each pore is filled with an Au member 13. The conditions of the electrolytic conditions are that the current density is 0.1 to 15 A/dm$^2$, the solution temperature is 50° to 70° C. and that the time is 10 to 120 minutes.

Figure 5:
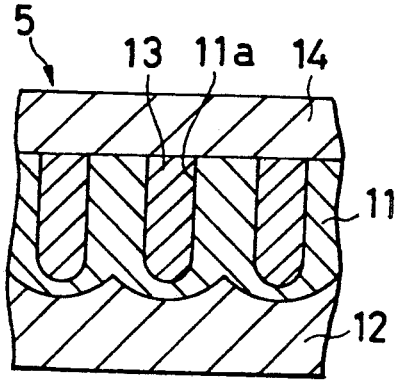

After that, as illustrated in FIG. 5, an Au film 14 is deposited over the film 11 to cover the pores 11*a* by an evaporation or sputtering process. The film 14 is then patterned by a photolithographic process to form an address line 5 having a desired line pattern.

Figure 6:
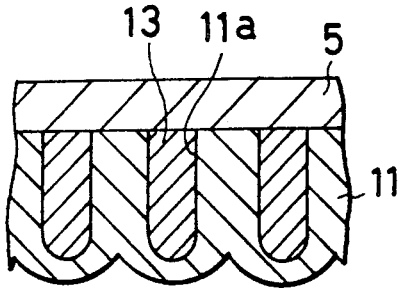

After that, as illustrated in FIG. 6, the Al portion 12 is removed by dissolution with the use of bromine-methanol solution, for instance.

Figure 7:
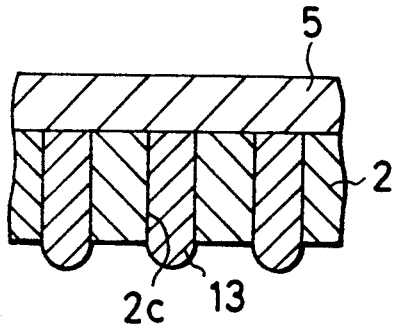
Figure 8:
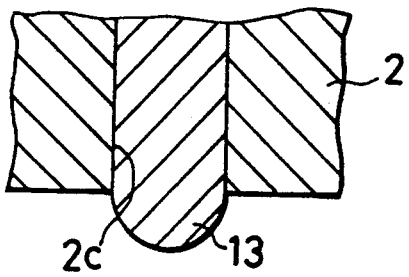

After that, a part of the film 11 (lower portion in this embodiment) is removed by dipping in phosphoric acid solution at a temperature of 20° to 50° C. for 10 to 60 minutes to reveal the Au members 13, as illustrated in FIGS. 7 and 8, and form an insulation member 2 having pores 2*c* filled with the member 13.

Figure 9:
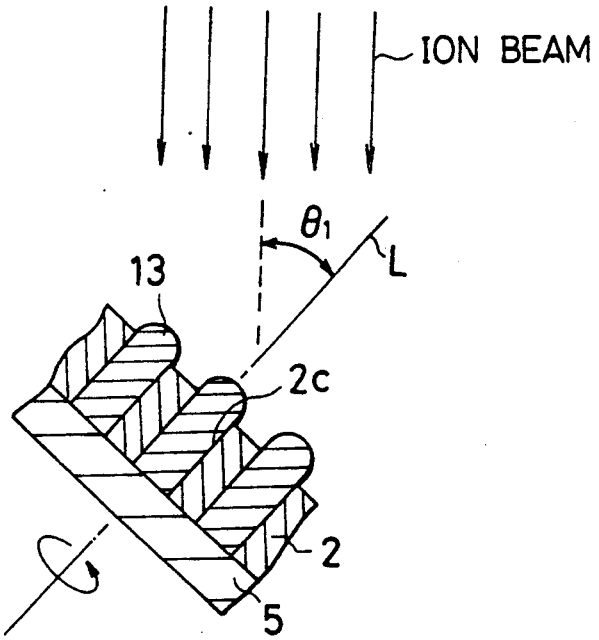
Figure 10:
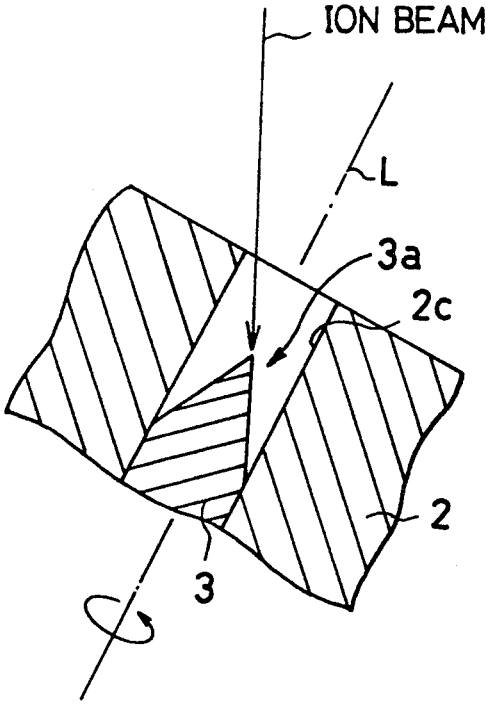

After that, as illustrated in FIG. 9, the insulation member 2 is arranged so that the axial line L of the pore 2*c* is inclined by angle $\theta_1$ with respect to the direction of ion beam irradiation. Ion beam is irradiated to the members 2 and 13 while rotating the member 2 about the line L. Thereby, a part of an end of the member 13 is removed by the ion beam etching function or the ion beam milling function so that chips 3 each having pointed end 3*a* are formed, as illustrated in FIG. 10.

It is to be noted that the member 2 functions as a mask for forming the pointed ends 3*a* and that the above-mentioned inclination angle $\theta_1$ is 10° to 45°.

The process mentioned above is one for forming chips each having pointed end by arranging the insulation member having the conductive members buried in the pores of the insulation member so that the axial direction of each pore is inclined with respect to the ion beam irradiation direction and that the ion beam is irradiated to the insulation member and the conductive member while the insulation member is rotated about the axial line of the pore.

Figure 11:
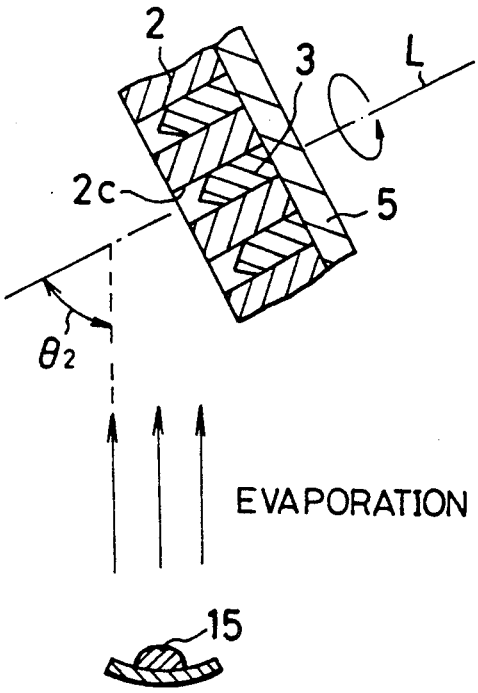
Figure 12:
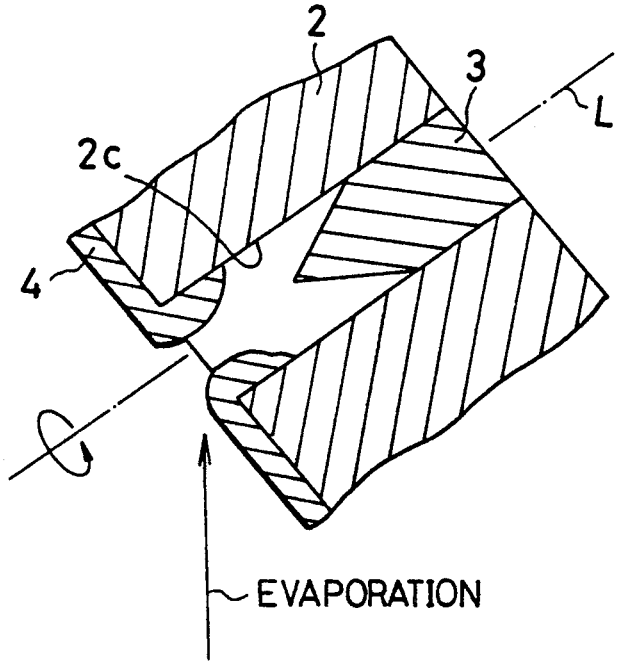

After that, as illustrated in FIG. 11, the member 2 is arranged so that the axial line L of the pore 2*c* is inclined by angle $\theta_2$ with respect to the evaporation direction of the Au source 15. In this state, Au is deposited on the member 2 to the thickness of about 500 Å so as to form the gate 4, as illustrated in FIG. 12. It is to be noted that the angle $\theta_2$ should be larger than the angle $\theta_1$.

The process of FIGS. 11 and 12 is the one for forming the gate by arranging the insulation member so that the axial direction of the pore of the insulation member is inclined with respect to the evaporation direction of the conductive member and evaporating the conductive member onto the insulation member while rotating the insulation member about the axial line.

As mentioned above, the electron emission element is produced by the chip forming process and the gate forming process taken after the chip forming process.

As mentioned above, in accordance with the embodiment of the present invention, since the insulation member 2 is formed from the anodic oxidation film 11 and the pores 11*a* of the film 11 are used as pores 2*c* of the member 2, it becomes possible to raise the density of chips 3 to $10^9$ to $10^{11}$ /cm$^2$, each chip 3 being defined as an electron emission member. Therefore, the density of the electron emission portion in the element is extraordinarily raised from that of the prior art which is about $10^5$ to $10^7$ /cm$^2$. Accordingly, it becomes possible to increase the number of electron emission portions per one pixel.

Also, it becomes unnecessary to use a photomask when forming the chips 3 or gates 4 since the insulation member 2 itself functions as the mask, which makes it possible to easily produce the electron emission portions and reduce the cost of the element. Therefore, the production throughput of the elements can be increased.

Besides, the emission area of the element 1 can be easily enlarged since the insulation member 2 is constituted from an anodic oxidation film of Al.

Many widely, different embodiments of the present invention may be constructed without departing from the spirit and scope of the present invention. It should be understood that the present invention is not limited to the specific embodiments described in the specification, except as defined in the appended claims.

What is claimed is:

1. An electron emitting element for use in a display device, comprising:

an electrical insulating member made of an anodic oxidation film and having a first surface, a second surface and a plurality of pores, said anodic oxidation film comprising aluminum oxide produced by an anodic oxidation process, each of said pores having an opening in said first surface;

a plurality of electron emitting members each made of conductive material, said electron emitting members being disposed in said pores respectively and each comprising a cylindrical portion and a cone-shaped portion integrally connected to said cylindrical portion at a base thereof such that a vertex of said cone-shaped portion is directed toward said opening, said pores being formed so that said electron emitting members have a density of $10^9$ to $10^{11}$ per $cm^2$;

an address line electrode formed on said second surface of said insulating member such that said electron emitting members are electrically connected to said address line electrode; and a gate electrode disposed on said first surface of said insulating member and having protrusions which each protrude in each of said pores towards said second surface of said insulating member, and which each terminates above said vertex of said cone-shaped portion.

2. An electron emitting element according to claim 1, in which said pores are formed substantially in parallel to each other.

3. An electron emitting element according to claim 1, in which each of said pores has a diameter of 10 to 30 nm.

* * * * *